US006436239B2

(12) United States Patent
Kustermann

(10) Patent No.: US 6,436,239 B2
(45) Date of Patent: Aug. 20, 2002

(54) METHOD TO REDUCE THE ADHESION OF A DAMP FIBROUS MATERIAL WEB TO A ROTATING ROLL

(75) Inventor: Martin Kustermann, Heidenheim (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 71 days.

(21) Appl. No.: 09/153,344

(22) Filed: Sep. 15, 1998

(30) Foreign Application Priority Data

Sep. 20, 1997 (DE) ..... 197 41 517

(51) Int. Cl.[7] ..... D21F 3/00; D21F 5/00

(52) U.S. Cl. ..... 162/206; 162/359.1; 162/375

(58) Field of Search ..... 162/199, 206, 162/207, 290, 375, 359.1, 358.1

(56) References Cited

U.S. PATENT DOCUMENTS

| | | | | |
|---|---|---|---|---|
| 3,097,933 A | | 7/1963 | Kellogg et al. | |
| 96,039 A | * | 10/1969 | Seeky | 100/74 |
| 3,560,333 A | * | 2/1971 | Douglas et al. | 162/206 |
| 3,655,507 A | * | 4/1972 | Nykopp | 162/358.1 |
| 3,798,785 A | | 3/1974 | Chamouton | |
| 4,351,700 A | * | 9/1982 | Dove | 162/359.1 |
| 4,596,333 A | * | 6/1986 | Attwood | 162/206 |
| 4,876,803 A | | 10/1989 | Wedel | |
| 4,889,598 A | | 12/1989 | Niskanen | 162/206 |
| 4,934,067 A | | 6/1990 | Wedel | |
| 4,976,820 A | | 12/1990 | Laapotti | 162/206 |
| 5,120,400 A | * | 6/1992 | Laapotti | 162/359.1 |
| 5,249,372 A | | 10/1993 | Wedel | |
| 5,318,670 A | | 6/1994 | Link et al. | 162/207 |
| 5,404,653 A | | 4/1995 | Skaugen et al. | |
| 5,483,873 A | * | 1/1996 | Koivukunnas et al. | 162/206 |
| 5,495,678 A | | 3/1996 | Ilmarinen et al. | |
| 5,507,104 A | | 4/1996 | Skaugen et al. | |
| 5,628,124 A | | 5/1997 | Skaugen et al. | |
| 5,636,448 A | | 6/1997 | Skaugen et al. | |
| 5,653,041 A | | 8/1997 | Ilmarinen et al. | |
| 5,832,625 A | | 11/1998 | Skaugen et al. | |

FOREIGN PATENT DOCUMENTS

| | | |
|---|---|---|
| DE | 579525 | 6/1933 |
| DE | 588546 | 11/1933 |
| DE | 1635343 | 4/1971 |
| DE | 4415581 | 1/1995 |
| EP | 620313 | 10/1994 |
| GB | 598111 | 2/1948 |
| WO | 90/01085 | 2/1990 |
| WO | 95/30795 | 11/1995 |
| WO | 96/01341 | 1/1996 |

* cited by examiner

*Primary Examiner*—Karen M. Hastings
(74) *Attorney, Agent, or Firm*—Greenblum & Bernstein, P.L.C.

(57) ABSTRACT

Method to reduce adhesion of a damp fibrous material web, e.g., a paper or material web, to a rotating roll. The method includes producing a steam cushion between the rotating roll and the fibrous material web.

8 Claims, 1 Drawing Sheet

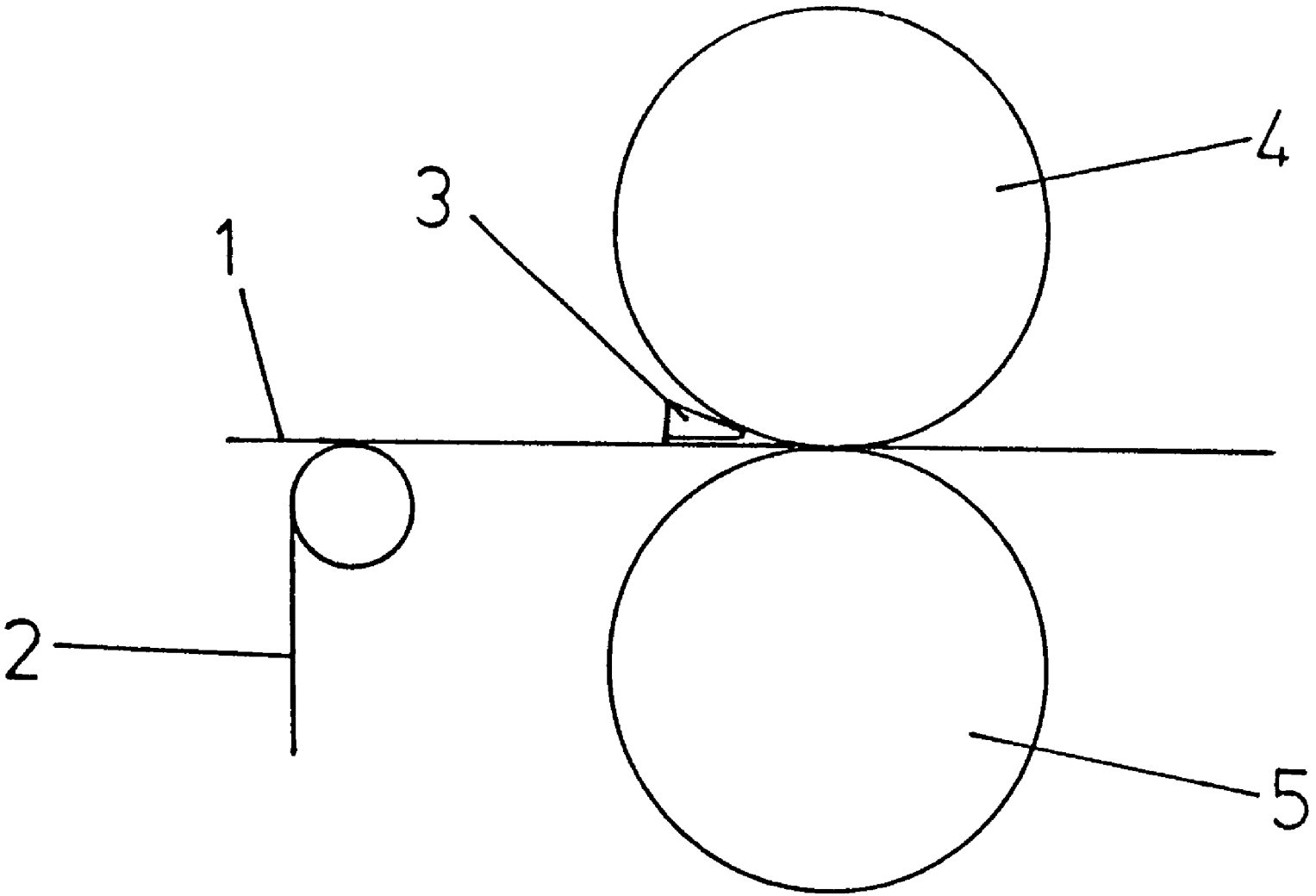
1
2
3
4
5

METHOD TO REDUCE THE ADHESION OF A DAMP FIBROUS MATERIAL WEB TO A ROTATING ROLL

CROSS-REFERENCE TO RELATED APPLICATIONS

The present application claims priority under 35 U.S.C. § 119 of German Patent Application No. 197 41 517.2, filed on Sep. 20, 1997, the disclosure of which is expressly incorporated by reference herein in its entirety.

BACKGROUND OF THE INVENTION

1. Field of the Invention

The present invention relates to a method to reduce adhesion of a damp web, e.g., paper, textile, or other fibrous material web, to a rotating roll.

2. Discussion of Background Information

Due to the ever-increasing speeds of machines for manufacturing and/or processing fibrous material webs, reducing adhesion of the damp fibrous material web to a smooth surface of rotating rolls is taking on increasing significance. The forces necessary to remove the fibrous material web from the roll increasingly effect the fibrous material web and can even result in a web break.

SUMMARY OF THE INVENTION

The present invention provides a method for reducing adhesion of the fibrous material web to a rotating roll.

In accordance with the present invention, a steam cushion is produced between the roll and the fibrous material web.

Since the steam cushion reduces or substantially hinders direct contact of the fibrous material web with the surface of the roll, the forces necessary for removing the fibrous material web from the roll are reduced considerably.

The steam cushion can be produced, e.g., by heating the roll to a very high temperature that is higher than necessary for the processing of the web. For example, the temperature of the surface of the roll can be heated to a temperature that produces steam from the damp material web, e.g., temperature values greater than approximately 120° C.

It is also possible to produce the steam cushion via heating of the roll and/or via blowing hot steam into an inlet opening between the roll and the fibrous material web.

The process is particularly applicable for use in parts of the machine in which the temperature of the fibrous material web is less than approximately 70° C. and/or the dry content of the fibrous material web is less than approximately 60%. The method of the present invention is particularly advantageous in these areas of the machine, e.g., press sections for draining or dryer section for drying, because adhesion is particularly strong.

Accordingly, the present invention is directed to a method to reduce adhesion of a damp fibrous material web to a rotating roll. The method includes producing a steam cushion between the rotating roll and the fibrous material web.

In accordance with another feature of the present invention, the producing of the steam cushion includes heating the rotating roll to a temperature that is higher than a temperature necessary for one of drying or draining of the fibrous material web. The heating of the rotating roll may include heating the surface of the rotating roll to a temperature of greater than approximately 120° C.

In accordance with another feature of the present invention, the method includes blowing steam into an inlet opening between the rotating roll and the fibrous material web.

In accordance with still another feature of the present invention, the temperature of the fibrous material web being guided to the rotating roll is less than approximately 70° C. and/or the dry content of the fibrous material web being guided to the rotating roll is less than approximately 60%. Further, the rotating roll can be located within a press section for draining the fibrous material web. The rotating roll can also be located within a dryer section for drying the fibrous material web.

In accordance with yet another feature of the present invention, the fibrous material web is composed of one of a paper and textile web.

In accordance with a further feature of the present invention, the fibrous material web guided to the rotating roll has at least one of the temperature of less than approximately 70° C. and a dry content of less than approximately 60%.

In accordance with a still further feature of the present invention, the rotating roll may be positioned in a section of a web producing machine in which the fibrous material web has at least one of the temperature less than approximately 70° C. and a dry content less than approximately 60%. Further, the rotating roll may be positioned in at least one of a press section and a dryer section. Still further, the rotating roll may be positioned in an initial area of the dryer section. The method may further include rewetting the fibrous material web in the dryer section prior to guiding the fibrous material web to the rotating roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of non-limiting examples of embodiments of the present invention, and wherein:

The FIGURE illustrates a web being guided through a press device.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the FIGURE, a portion of a press section is depicted in which a fibrous material web 1 is guided through a press nip (opening) by a continuous draining felt 2. The press nip is formed by two rolls 4 and 5, in which roll 4 has a smooth surface.

To reduce adhesion of fibrous material web 1 to the smooth surface of roll 4, roll 4 is heated to as high a temperature as possible, e.g., over approximately 120° C. In this manner, evaporation of a part of the water in fibrous material web 1 occurs to form a steam cushion between fibrous material web 1 and roll 4. Various different heating systems may be utilized, e.g., electric systems or heated oil based systems, for heating roll 4. Moreover, hot steam may be blown into an inlet side of the nip between roll 4 and fibrous material web 1 via a steam blow box 3. In this manner, the steam cushion may be enlarged.

The present invention may also be utilized in dryer sections in which heated dryer cylinders are looped by fibrous material web 1. The dryer cylinders can be heated to a temperature substantially higher than a temperature necessary for drying the web so as to create the steam cushion. Further, steam blow boxes 3 may be arranged at an inlet opening between fibrous material web 1 and the dryer cylinder.

Because the process can be advantageously practiced where the temperature of fibrous material web 1 is under approximately 70° C. and/or the dry content of fibrous material web 1 is under approximately 60%, the most advantageous areas within the dryer section of the web producing machine for practicing the method of the present invention is in an initial area of the dryer section or in an initial area of an end drying section, e.g., if a strong rewetting occurs in a size press or the like.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method to reduce adhesion of a damp fibrous material web to a rotating roll comprising:

producing a steam cushion between the rotating roll and the damp fibrous material web, wherein the steam cushion is at least partially produced by blowing steam into an inlet opening between the rotating roll and the damp fibrous web, wherein the steam cushion is further at least partially produced by heating the rotating roll to a temperature higher than necessary for one of drying or draining the damp fibrous material web, whereby a temperature of a surface of the rotating roll is greater than approximately 120° C., and by a temperature of the damp fibrous material web being guided to the rotating roll being less than approximately 70° C., and wherein a dry content of the damp fibrous material web being guided to the rotating roll is less than approximately 60%.

2. The method in accordance with claim 1, wherein the rotating roll is located within a press section for draining the damp fibrous material web.

3. The method in accordance with claim 1, wherein the rotating roll is located within a dryer section for drying the damp fibrous material web.

4. The method in accordance with claim 1, wherein the damp fibrous material web is composed of one of a paper and textile web.

5. The method in accordance with claim 1, wherein the rotating roll is positioned in a section of a web producing machine in which the damp fibrous material web has a dry content less than approximately 60%.

6. The method in accordance with claim 5, wherein the rotating roll is positioned in at least one of a press section and a dryer section.

7. The method in accordance with claim 6, wherein the rotating roll is positioned in an initial area of the dryer section.

8. The method in accordance with claim 6, further comprising:

rewetting the fibrous material web in the dryer section prior to guiding the damp fibrous material web to the rotating roll.

* * * * *